United States Patent [19]

Tillotson

[11] Patent Number: 4,632,850

[45] Date of Patent: Dec. 30, 1986

[54] CARPET COATING METHOD AND APPARATUS

[76] Inventor: John G. Tillotson, 1311 Dana Dr., Dalton, Ga. 30720

[21] Appl. No.: 730,068

[22] Filed: May 2, 1985

[51] Int. Cl.[4] ..... B05D 3/12; B05C 3/02; D06B 1/00; D06F 35/00

[52] U.S. Cl. ..... 427/356; 8/151; 68/200; 118/407; 118/415; 427/358; 427/359

[58] Field of Search ..... 8/151; 68/200; 118/407, 118/415; 427/356, 358, 359, 389.9

[56] References Cited

U.S. PATENT DOCUMENTS

| | | | |
|---|---|---|---|
| 1,405,198 | 1/1922 | Frothingham et al. | 427/428 |
| 2,271,458 | 1/1942 | Lionne | 91/68 |
| 2,512,727 | 6/1950 | Rice | 154/76 |
| 2,784,630 | 3/1957 | Koprow et al. | 18/57 |
| 2,813,052 | 11/1957 | Lancaster | 428/245 X |
| 2,970,564 | 2/1961 | Warner | 118/259 |
| 3,537,946 | 11/1970 | Truax et al. | 156/72 X |
| 3,560,310 | 2/1971 | Bolton | 156/552 |
| 3,726,750 | 4/1973 | Stillings | 156/62.4 X |
| 3,728,182 | 4/1973 | Wisotzky et al. | 156/72 |
| 4,086,377 | 4/1978 | Barchi | 427/373 X |
| 4,205,112 | 5/1980 | Mervin | 427/373 X |
| 4,219,376 | 8/1980 | Roman | 427/412 X |
| 4,239,821 | 12/1980 | McLean et al. | 428/95 |
| 4,275,683 | 6/1981 | Kutz et al. | 118/407 |

OTHER PUBLICATIONS

Comparison of Low Wet Pickup Finish Applicators for Cotton Fabrics; *Textile Industries*; Oct. 1984.

*Primary Examiner*—Michael R. Lusignan
*Attorney, Agent, or Firm*—Jones & Askew

[57] ABSTRACT

A method and apparatus for coating the back of carpet products providing improved control over coating weight, uniformity, and penetration. A layer of adhesive is formed on a rotating coating roll, and the upper edge of an applicator blade is brought into contact with the coated roll. The layer of adhesive is transferred to the upper edge of the applicator blade and flows under the effect of gravity to the lower edge of the blade. The back of the carpet is then pressed against the lower edge of the blade, simultaneously applying and spreading the adhesive.

15 Claims, 1 Drawing Figure

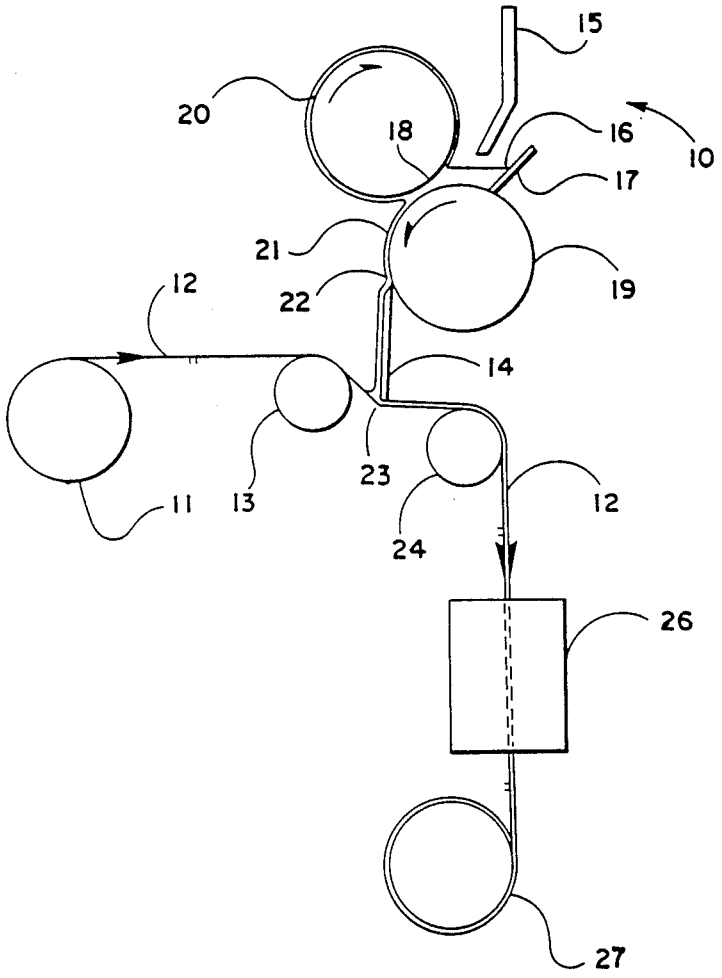
15
20
18
16
10
17
21
19
12
22
14
23
11
13
12
24
26
27

CARPET COATING METHOD AND APPARATUS

TECHNICAL FIELD

This invention relates generally to methods and apparatus for coating textiles, and relates more specifically to an improved method and apparatus for coating the back of carpet.

BACKGROUND OF THE INVENTION

It is well known to coat the back of tufted carpets with adhesive materials to anchor component fibers in a desired configuration. The adhesive coating anchors the individual pile yarns to the carpet backing and prevents unwanted fiber movement and slippage which might otherwise result in fuzzing or wrinkling of the carpet. Excess adhesive, however, can intrude through the carpet backing to the face of the carpet, thereby causing undue stiffness in the pile yarns. Accordingly, it is important that penetration of adhesive into the backs of the pile yarns and into the carpet backing be carefully controlled so that adequate fiber anchoring is achieved without intrusion of adhesive into the face or pile surface of the carpet.

The amount of adhesive used and uniformity of application affect the flexibility or hand of the carpet. Additionally, it is important to control the amount of adhesive applied for economic reasons. Thus, a method of coating is needed which achieves a uniform coating and minimum waste while minimizing the amount of adhesive employed.

Carpet coating materials have been previously applied using several different methods. One such method comprises using a spray system with single or multiple spray nozzles mounted in fixed or traversable carriages to spray the back of the carpet with an adhesive material. Coating uniformity and weight are difficult to control because of the overlap of spray patterns and the variation of spray output caused by nozzle blockage. Additionally, overspray of the edges of the carpet usually occurs, resulting in wasted adhesive.

Another method of coating the back of a carpet is a transfer coating method. A layer of coating material is formed on a moving surface such as a roll, and the back of the carpet is pressed on wiped against the preformed layer to transfer the coating material from the moving surface to the carpet back. Adequate control of the amount of coating material transferred to the carpet is difficult to achieve because the layer of coating material on the roll cannot be transferred uniformly to the rough surface which is characteristic of a carpet back. Also, because of the inherently large contact area between the roll and the carpet back, the force exerted by the roll against the carpet is spread out over such a large area that there is insufficient pressure between them, making adequate penetration of the coating material into the pile yarn backs hard to achieve.

The most widely used carpet coating method comprises applying an excess of adhesive directly onto the carpet back, and then scraping the deposited adhesive with a bar or blade to spread the adhesive and remove the excess. Using this method, however, it is extremely difficult to control the amount of adhesive used and the degree of penetration achieved. Factors such as the viscosity fo the coating material, the absorbency of the carpet fibers, the amount of excess coating material deposited on the carpet back, the dwell time between deposition and scraping of the coating material, and the ambient conditions all affect the amount of coating material used and the degree of penetration achieved.

SUMMARY OF THE INVENTION

As will be seen the method and apparatus of the present invention overcomes these and other problems associated with conventional carpet coating methods. Stated generally, the present invention provides a carpet coating method which makes possible improved control of carpet coating weight, uniformity, and penetration. Furthermore, this control is provided independently of coating material viscosity, carpet fiber absorbency, and ambient conditions. The invention also provides a coating method which avoids excessive use and waste of coating materials.

Stated somewhat more specifically, the method of the present invention comprises first forming a layer of adhesive of predetermined thickness on a horizontal roll rotating at a predetermined speed. The upper edge of an applicator blade is contacted with the rotating roll such that the layer of adhesive is transferred onto the blade. The adhesive flows down the blade under the effect of gravity to the lower edge of the blade. The back of a carpet is then brought into intimate contact with the lower edge of the applicator blade, thereby transferring and simultaneously spreading the adhesive onto the carpet back.

The apparatus of the present invention includes a coating roll mounted for rotation about a horizontal axis. A traveling dispenser meters a latex adhesive onto the upper surface of the coating roll, and a doctor roll in parallel spaced apart relation to the coating roll doctors the adhesive into a layer on the coating roll. An applicator blade is positioned so that its upper edge contacts the coating roll, and the layer of adhesive is transferred from the coating roll to the blade. The rotational speeds of the rolls and the spacing between the rolls are adjustable to control the amount of adhesive delivered to the blade.

The adhesive flows down the blade to its lower edge. Conventional carpet conveying means move a carpet past the lower edge of the blade such that the blade simultaneously applies and spreads the adhesive onto the back of the carpet. Adjustable positioning rolls permit the path of the carpet to be controlled in relation to the blade so that the degree of adhesive penetration can be regulated.

Thus, it is an object of the present invention to provide a method and apparatus for coating the back of a carpet which makes possible improved control of the amount of carpet coating material used.

It is another object of the present invention to provide a carpet coating method and apparatus which provides improved control over the penetration of the adhesive into the carpet fibers.

It is yet another object of the present invention to provide a method and apparatus for coating a carpet back which achieves a uniform coating while minimizing adhesive waste.

It is a further object of this invention to provide a carpet coating method which achieves the foregoing objectives independently of coating material viscosity, carpet fiber absorbency, and ambient conditions.

Other objects, features, and advantages of the present invention will become apparent upon reading the following specifications when taken in conjunction with the drawing and the appended claims.

BRIEF DESCRIPTION OF THE DRAWING

FIG. 1 is a side view of the preferred embodiment of the apparatus of the present invention.

DETAILED DESCRIPTION OF THE DISCLOSED EMBODIMENT

Referring now in more detail to the drawing, FIG.1 shows a carpet coating apparatus 10. A substantially horizontal coating roll 19 is suitably mounted for rotation about its axis. A counterrotating doctor roll 20 is mounted in parallel spaced-apart relation to the coating roll 19 to form an opening 18 therebetween. Conventional drive means known in the art rotate the rolls 19, 20.

A supply of adhesive is delivered by a nozzle 15 to an adhesive reservoir 16 defined by the coating roll 19, by the doctor roll 20, by a containment blade 17, and by suitable end dams (not shown). A layer 21 of adhesive is formed on the coating roll 19 by the movement of the coating roll surface drawing the adhesive through the opening 18 between the parallel rolls 19, 20.

An applicator blade 14 has an upper edge 22 in intimate contact with the coating roll 19. The applicator blade of the present invention is constructed of 1/32 inch spring steel at its upper and lower edges 22, 23, and the body of the blade is reinforced (not shown) to provide a rigid body. The layer 21 of adhesive is transferred to the upper edge 22 of the blade 14 and flows down the blade under the effect of gravity to the lower edge 23 of the blade 14.

While the blade 14 of the preferred embodiment is positioned at an angle of approximately seventy degrees to horizontal, it will be appreciated that the blade can be positioned at a wide range of angles with respect to horizontal and still provide an acceptable flow of adhesive down the blade from its upper edge 22 to its lower edge 23. One obvious limitation for the angle of the blade is that it slope downwardly from its roll-contacting edge 22 such that the adhesive transferred to its upper edge will flow down the blade. A steeply sloping blade will permit the adhesive to flow down the blade faster than a shallowly sloping blade. However, once equilibrium has been reached, i.e. once the blade is completely covered with coating material and the coating material has reached the lower edge of the blade, then the adhesive will flow off the lower edge 23 of the blade as fast as it is being transferred to the upper edge 22 irrespective of the slope of the blade.

Another limitation for the slope of the blade is that if the blade is angled downwardly more than ninety degrees, then, depending upon the flow characteristics of the coating material, the material will tend to fall off the blade rather than flow smoothly down it.

The preferred point at which the upper edge 22 of the blade 14 contacts the coating roll 19 is approximately one quarter turn from the top of the coating roll in its direction of rotation. If the point of contact is further down the coating roll, the layer of coating material formed on the coating roll will tend to fall off the roll before it can be transferred to the upper edge 22 of the blade 19. Contact points further up the coating roll are permissible, within the physical constraints imposed by the presence of the doctor roll 20.

A wide range of angles of the applicator blade 14 with respect to the coating roll 19 will permit an acceptable transfer of the coating material from the coating roll to the blade. A smooth transfer is effected if the blade is substantially tangential to the coating roll at the point of contact. However, while other angles may cause turbulence and an accumulation of coating material at the upper edge 22 of the blade, once equilibrium has been reached as described above, coating material will be supplied to the lower edge 23 of the blade at a constant rate irrespective of any turbulence or accumulations at the upper edge.

A tufted carpet 12 from a carpet supply roll 11 is conveyed upside down along a predetermined path and across a moveable carpet positioning roll 13. The back of the carpet 12 is brought into intimate contact with the lower edge 23 of the applicator blade 14, thereby simultaneously transferring the layer 21 of adhesive from the blade and spreading it onto the carpet back. The carpet 12 is then conveyed to a second moveable carpet positioning roll 24 and then conveyed through a conventional heat treating means 26 to solidify the adhesive. Thereafter, the finished carpet product is stored on a carpet take-up roll 27.

So that the scraping pressure of the carpet against the blade can be controlled, the carpet positioning rolls 13, 24 can be positioned relative to the applicator blade 14 to control the angle formed between the carpet 12 and the applicator blade and the tension of the carpet as it is conveyed past the blade. Extremely irregular back surfaces of some carpets are difficult to coat uniformly. This difficulty may be overcome by increasing the scraping pressure between the carpet 12 and the applicator blade 14, thereby more effectively spreading the adhesive over the surface to be coated.

The amount of adhesive delivered onto the back of the carpet 12 can be controlled in a number of ways. First, the spacing 18 between the coating roll 19 and the doctor roll 20 can be controlled to control the thickness of the adhesive layer 21 formed on the coating roll. As the spacing 18 is increased, the thickness of the adhesive layer 21 increases; and as the spacing 18 is decreased, the adhesive is doctored into a thinner layer. The amount of adhesive transferred onto the applicator blade 14, and hence the amount of adhesive applied to the carpet back, can thus be increased or decreased by increasing or decreasing the spacing 18 between the rolls.

Another manner in which the amount of adhesive applied to the back of the carpet can be controlled is by controlling the speed of rotation of the coating roll 19. For a layer of adhesive 21 of constant thickness on the coating roll 19, rotating the coating roll faster will increase the amount of adhesive delivered to the applicator blade, and consequently the amount of adhesive applied to the back of the carpet. Similarly, slowing the speed of rotation of the coating roll 19 will decrease the amount of adhesive applied to the carpet back.

The rotational speed of the doctor roll 20 relative to the coating roll 19 can also affect the thickness of the layer 21 of coating material on the coating roll. As the rotational speed of the doctor roll 20 is decreased, the amount of coating material formed onto the coating roll 19 is increased. Similarly, as the doctor roll 20 rotates faster, more coating material forms on the doctor roll and correspondingly less on the coating roll 19.

Yet another method for controlling the amount of adhesive applied to the carpet is to control the speed at which the carpet 12 is conveyed past the lower edge 23 of the applicator blade 14. For a given amount of adhesive transferred from the coating roll 19 onto the applicator blade, the amount of adhesive transferred to a given area of carpet can be controlled by controlling the speed at which the carpet is moved past the applicator blade. Moving the carpet past the blade 14 at a higher speed will result in less adhesive being applied per area of carpet back. Conversely, moving the carpet past the applicator blade at a slower speed will result in more adhesive being applied per area of carpet back.

Thus, by controlling these factors—the spacing between the doctor blade and the coating roll, the rotational speed of the coating roll, the rotational speed of the doctor roll relative to the coating roll, and the speed at which the carpet is conveyed past the applicator blade—maximum control can be achieved over the amount of adhesive applied to the back of the carpet.

One advantage of the present invention is that since substantially all of the adhesive delivered into the coating material reservoir 16 is delivered onto the back of the carpet, adhesive waste is virtually eliminated.

Another advantage of the present invention is that, since the rate at which adhesive is delivered into the reservoir substantially corresponds to the rate at which adhesive is applied onto the carpet back, it is possible to exercise a high degree of control over the amount of adhesive on the carpet back. By employing conventional metering devices to measure the speed at which the carpet is conveyed past the applicator blade, and by adjusting the spacing 18 between the coating roll 19 and the doctor roll 20, the rotational speed of the coating roll, and the rotational speed of the doctor roll relative to the coating roll to maintain the reservoir at a constant level, the rate at which adhesive is delivered into the reservoir can be controlled to provide the desired amount of adhesive per unit area of carpet.

It has been found that the preferred coating material for anchoring the fibers on the back of a carpet is carboxylated SBR latex. Other acceptable coating materials include natural rubber latex, styrene/butadiene latex, ethylene vinyl acetate latex, acrylic latex, polyurethane elastomers, polyurethane foams, polyvinyl chloride plastisols, and hot melt resins.

It will be appreciated by those skilled in the art that other moving surfaces may be substituted for the coating roll, for example a conveyor belt to permit the treatment of the coating material subsequent to deposition but before transfer to the applicator blade.

It will further be appreciated that the method and apparatus of the present invention can be applied to coat fibrous webs other than carpets, such as paper and cloth fabrics.

Finally, it will be understood that the preferred embodiment of the present invention has been disclosed by way of example, and that other modifications may occur to those skilled in the art without departing from the scope and spirit of the appended claims.

What is claimed is:

1. A method for applying a liquid or semi-liquid coating material to the back of a carpet, comprising the steps of:

forming said coating material into a layer on a substantially horizontal rotating coating roll;

transferring said layer of coating material from said coating roll to the upper edge of an applicator blade by contacting said upper edge of said blade against said coating roll;

flowing said coating material under the effect of gravity from said upper edge of said blade to the lower edge of said blade;

transferring said coating material onto said back of said carpet by contacting said lower edge of said blade against said back of said carpet; and simultaneous with said step of transferring said coating material onto said back of said carpet, spreading said coating material onto said back of said carpet by moving said carpet past said lower edge of said blade.

2. The method of claim 1, further comprising the step of controlling the thickness of said coating material on the back of said carpet by controlling the speed at which said carpet is moved past said lower edge of said blade.

3. The method of claim 1, further comprising the step of controlling the rate at which the coating material is transferred onto the back of the carpet by controlling the rotational speed of said coating roll.

4. The method of claim 1, wherein said step of forming said liquid coating material into a layer on said coating roll comprises passing said coating material on said coating roll under a rotating doctor roll positioned in parallel spaced-apart relation to said coating roll.

5. The method of claim 4, further comprising the step of controlling the rate at which the coating material is transferred onto the back of the carpet by controlling said spaced-apart relation between said rolls.

6. The method of claim 4, further comprising the step of controlling the rate at which said coating material is transferred onto the back of said carpet by controlling the rotational speed of said doctor roll.

7. The method of claim 1, wherein said step of forming said liquid coating material into a layer on said coating roll comprises passing said coating material on said coating roll under a doctor blade positioned in parallel spaced apart relation to said coating roll.

8. The method of claim 1, further comprising the step of controlling the degree to which said coating material penetrates the back of said carpet by controlling the angle of said blade in relation to said carpet as said carpet is moved past said the lower edge of said blade.

9. The method of claim 1, wherein said step of spreading said coating material onto the back of said carpet by moving said carpet past said lower edge of said blade comprises moving said carpet past said lower edge of said blade along a path, and further comprising the step of controlling said path along which said carpet is moved to regulate the angle of said carpet in relation to said lower edge of said blade, whereby the degree to which said coating material penetrates the back of said carpet is controlled.

10. A method for applying a liquid or semi-liquid coating material to a fibrous web, comprising the steps of:

forming the coating material into a layer on a moving surface;

transferring said layer of coating material from said moving surface to the upper edge of an applicator blade by contacting said upper edge of said blade against said moving surface;

flowing said coating material under the effect of gravity from said upper edge of said blade to the lower edge of said blade;

transferring said coating material onto the back of the fibrous web by contacting said lower edge of said blade against the back of the fibrous web; and simultaneous with said step of transferring said coating material onto the back of the fibrous web, spreading said coating material onto the back of the fibrous web by moving the fibrous web past said lower edge of said blade.

11. An apparatus for applying a liquid or semi-liquid coating material onto the back of a carpet, comprising:

a rotating coating roll;

means for depositing the liquid coating material onto said coating roll;

means for doctoring said deposited coating material into a layer on said coating roll;

an applicator blade having an upper and a lower edge, said upper edge of said blade being in intimate contact with said rotating coating roll such that said layer of coating material is transferred from said coating roll to said upper edge of said blade and flows under the effect of gravity to said lower edge of said blade; and means for conveying said carpet along a path such that the back of said carpet is pressed against said lower edge of said blade, whereby said coating material is simultaneously transferred and spread onto the back of said carpet.

12. The apparatus of claim 11, wherein said doctoring means comprises a rotating doctor roll in parallel spaced apart relation to said coating roll.

13. The apparatus of claim 12, further comprising means for controlling the space between said doctor roll and said coating roll.

14. The apparatus of claim 11, further comprising means for controlling said path along which the carpet is conveyed, whereby the angle of the carpet relative to said blade can be controlled.

15. The apparatus of claim 14, wherein said means for controlling said path along which the carpet is conveyed comprises independently positionable rolls on either side of said blade over which the carpet is conveyed, whereby the position of said rolls relative to said applicator blade can be controlled to control the scraping pressure between said carpet and said blade.

* * * * *